United States Patent [19]

Ziegler

[11] 4,453,726

[45] Jun. 12, 1984

[54] ROLLER SKATE OR THE LIKE WITH BRAKE ATTACHMENT

[75] Inventor: Gerd W. Ziegler, Heiligenhaus, Fed. Rep. of Germany

[73] Assignee: TSH-Handels AG, Vaduz, Liechtenstein

[21] Appl. No.: 250,670

[22] Filed: Apr. 3, 1981

[30] Foreign Application Priority Data

May 9, 1980 [DE] Fed. Rep. of Germany ..... 3017762
Oct. 31, 1980 [DE] Fed. Rep. of Germany ..... 3041042

[51] Int. Cl.[3] ..... A63C 17/14
[52] U.S. Cl. ..... 280/11.2
[58] Field of Search ..... 280/11.2, 11.3–11.33, 280/87.04 A; 188/72.7, 71.3, 26; 308/173

[56] References Cited

U.S. PATENT DOCUMENTS 333,751 1/1886 Harris ..... 280/11.2
334,739 1/1886 Blum ..... 280/11.2
1,374,464 4/1921 Nall ..... 280/11.19
2,174,398 9/1939 Farmer ..... 188/71.3
3,945,655 3/1976 Banks ..... 280/11.2
4,272,090 1/1981 Wheat ..... 280/11.28

*Primary Examiner*—David M. Mitchell
*Assistant Examiner*—Timothy Roesch
*Attorney, Agent, or Firm*—Karl F. Ross

[57] ABSTRACT

A roller skate has a truck supporting its rear-wheel axle on which a rearwardly extending rocker is swingable about a horizontal axis, the rear end of this rocker carrying a control roller while its front end engages or forms a pair of pressure elements disposed between the rear wheels. Normally, with all four wheels touching the ground, the control roller is elevated above the road surface; when, however, the front of the skate is lifted in a pivotal motion about the rear axle, this roller contacts the ground and causes the rocker to swing against a spring force whereby the pressure elements are cammed outward to engage the inner faces of the rear wheels for exerting a braking force thereon. The wheel faces may be clad with thin metal disks which coact with the pressure elements and which also form seats for wheel-supporting ball bearings.

16 Claims, 14 Drawing Figures

ROLLER SKATE OR THE LIKE WITH BRAKE ATTACHMENT

FIELD OF THE INVENTION

My present invention relates to a wheeled skating device, such as a roller skate or a skate board, having at least one front wheel and a pair of rear wheels which are secured by respective mountings known as trucks to a thread plate or directly to the shoe of a user.

BACKGROUND OF THE INVENTION

Such a device, and especially a roller skate with pairs of front and rear wheels journaled on respective transverse axles, is conventionally provided with a front bumper or stop of plastic material designed to facilitate push-off, figure skating and similar maneuvers. These stops, however, are generally not usable for braking at high speeds since, on the one hand, such action would result in rapid wear of the bumper and, on the other hand, the location of the stop at the forward end of the device may potentially give rise to accidents due to a flipping about the front-wheel axle.

In light of the high speeds attainable with today's efficiently constructed roller skates and skate boards, however, it is desirable to provide these devices with means for enabling a controlled deceleration or stopping whenever a need therefor should arise.

OBJECT OF THE INVENTION

The object of my present invention, therefore, is to provide such a device with effective brake means for the purpose described.

SUMMARY OF THE INVENTION

In accordance with my present invention, a rocker member is fulcrumed on a truck member supporting the rear axle of a wheeled skating device, with a pivotal axis perpendicular to the rear wheels thereof, and has a tail end carrying a control roller rearwardly of that axle. During normal running, with all the wheels resting on a road surface, the control roller is held elevated above the ground and is biased by resilient means tending to maintain the rocker member in a predetermined limiting position relative to the associated truck member. One of these two members carries a pair of pressure elements, disposed close to the rear wheels and displaceable substantially parallel to their axle, while the other member is provided with camming means coacting with these pressure elements for driving them into frictional engagement with the rear wheels upon an elevation of the front wheel sufficient to lower the control roller onto the road surface and to swing the rocker member about its pivotal axis against a countervailing biasing force so as to exert a braking effect upon these wheels.

When the rear wheels consist of a polymeric material such as polyurethane, for example, I prefer to provide their inner faces confronting the pressure elements with a pair of wear-resistant liners in the form of metallic disks which advantageously may also constitute seats for ball, needle or other antifriction bearings supporting the rear wheels.

In an advantageous embodiment, the truck member forms a housing in which the pressure elements are slidably received, the camming means comprising a spring-loaded spreader which is carried by the rocker member and interposed between the pressure elements for separating them upon an upward swing of the roller-carrying tail end. The resilient restoring force may be supplied in that case by a coil spring surrounding a tip of the spreader guided in an upper or lower housing wall, the spring being inserted between that wall and a tapering section of the spreader which could be either frustoconical or wedge shaped with a vertex angle in a range of about 8° to 22°, preferably around 15°.

Alternatively, the rocker member may be designed as a bracket straddling a preferably upwardly convergent extension of the truck member with a pair of wedge-shaped formations on forward extremities of two flexible lateral arms, these formations serving as the pressure elements. The countervailing biasing force may be provided in this instance by the resiliency of the bracket itself, especially by a rear part of that bracket interconnecting its lateral arms.

BRIEF DESCRIPTION OF THE DRAWING

The above and other features of my invention will now be described in detail with reference to the accompanying drawing in which.

SPECIFIC DESCRIPTION

Figure 1:
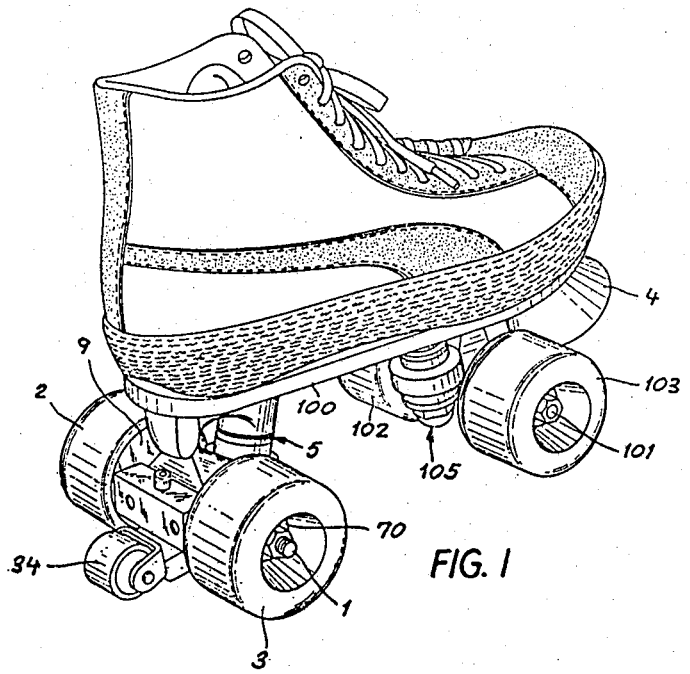
FIG. 1 is a perspective view of a roller skate showing a brake attachment according to my invention associated with its rear wheels.

In FIG. 1, I have shown a roller skate comprising a tread plate 100 supporting the shoe of a user, a pair of rear wheels 2, 3 on an axle 1 and a pair of front wheels 102, 103 on an axle 101. Axles 1 and 101 are mounted on plate 100 with the aid of respective metallic trucks generally designated 5 and 105. The front of plate 1 also carries a conventional stop 4 which, like wheels 2, 3, 102 and 103, may consist of polyurethane or the like.

Figure 2:
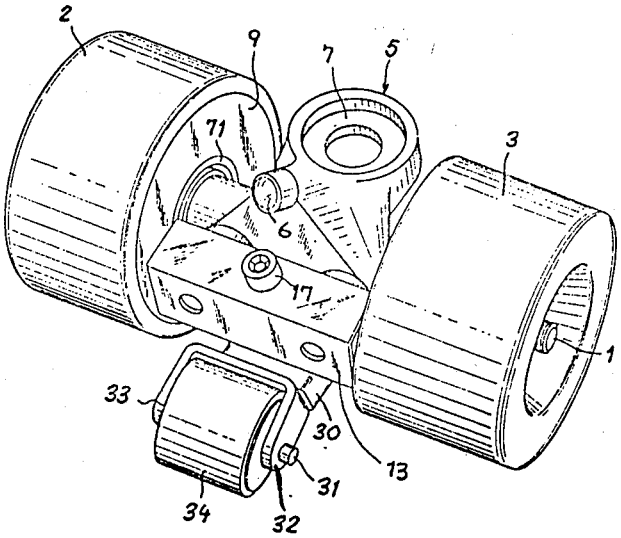
FIG. 2 is a perspective view of the assembly of rear wheels and brake attachment.

Each truck 5 and 105, as more particularly illustrated for truck 5 in FIG. 2, is secured to the plate 100 in well-known manner by a screw (not shown) traversing a socket 7 and by a boss 6 fitting into a complementary nipple on plate 100 to prevent swiveling about the screw axis. Each wheel is journaled on its axle by an outer and an inner bearing as particularly illustrated in FIGS. 1 and 2 for an outer rear-wheel bearing 70 and an inner rear-wheel bearing 71.

Figure 3:
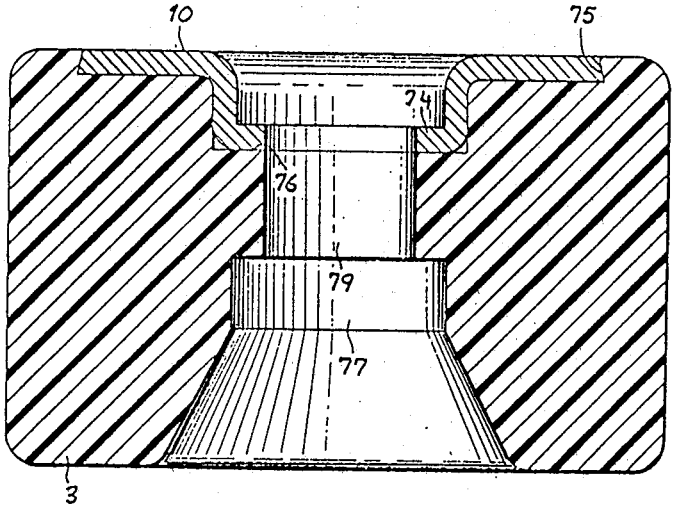
FIG. 3 is a cross-sectional view of one of the rear wheels shown in FIGS. 1 and 2.
Figure 4:
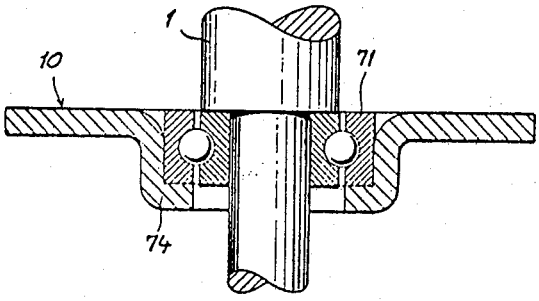
FIG. 4 is a cross-sectional view of a metal disk, secured to the wheel of FIG. 3, and of a ball bearing seated in that disk.

FIGS. 1, 2 and 3 also show metal disks 9 and 10 received in recesses 75 of the inner faces of rear wheels 2 and 3; these disks preferably consist of stainless sheet steel about 2 mm thick. A perforated central portion 74 of each disk is swaged to fit into a depression 76 for the purpose of accommodating the inner ball bearing 71 as illustrated in FIG. 4. Disks 9 and 10 may be held in their recesses 75 by adhesive bonding, for example. Another depression 77 (FIG. 3) of each wheel accommodates its outer bearing 70. The two recesses 76 and 77 are interconnected by a bore 79 to be traversed by axle 1.

Figure 5:
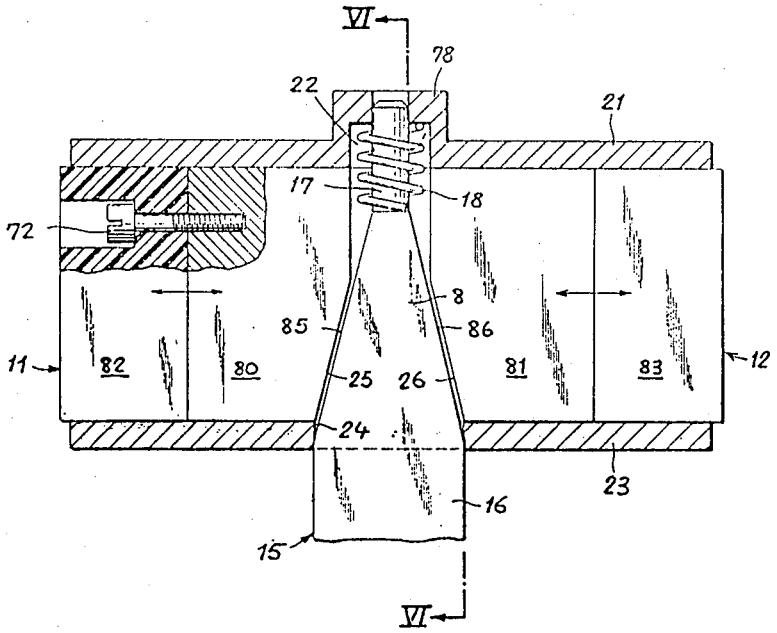
FIG. 5 is a longitudinal sectional view of a housing, forming part of the brake attachment of FIGS. 1 and 2, and of a pair of pressure elements in that housing coacting with a spreader.
Figure 10:
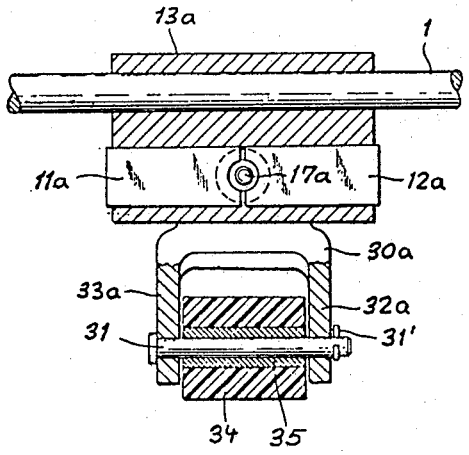
FIG. 10 is a sectional top view taken on the line X—X of FIG. 8.

A prismatic housing 13 rigid with truck 5, disposed rearwardly of axle 1, surrounds two pressure elements 11 and 12 for sliding movement parallel to the axle as illustrated in FIG. 5; the truck and the housing may be formed as a unitary casting. A spreader 15, also shown in FIG. 6, penetrates from below into housing 13 while resting on a bifurcate rocker member 30 (FIG. 2) which is fulcrumed on truck 5 for vertical swinging about a pivotal axis parallel to wheel axle 1 as more particularly illustrated in FIG. 8 with reference to a similar rocker member 30*a*. Rocker 30 has a bifurcate tail end with prongs 32, 33 between which a control roller 34, preferably of the same polymeric material as wheels 2 and 3, is journaled on a headed stud 31 held in position by a cotter pin 31′ as illustrated in FIG. 10. Spreader 15 has a prismatic base 16 guided in a correspondingly shaped cutout 24 of a lower housing wall 23, a wedge-shaped intermediate section 8 with upwardly converging flanks 85 and 86 adjoining similarly beveled faces 25 and 26 of pressure elements 11 and 12, and a cylindrical tip 17 guided in a bore of an outward projection 78 of an upper housing wall 21. A coil spring 18, surrounding the tip 17 of spreader 15 within a recess 22 of projection 78, bears on the one hand upon the top of that recess and on the other hand upon a shoulder separating the tip 17 from the tapering intermediate section 8.

Figure 8:
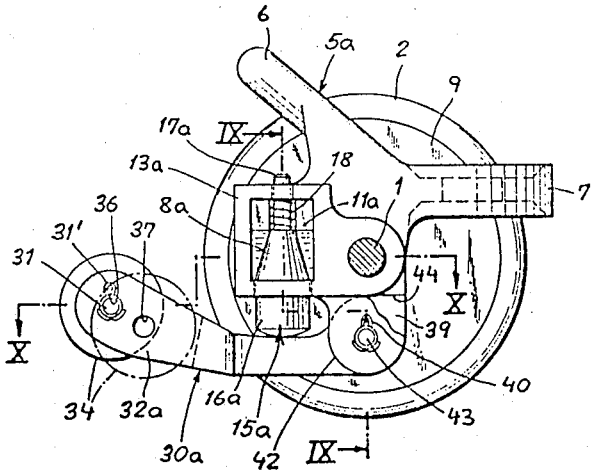
FIG. 8 is a side view of a modified brake attachment according to my invention with one of its pressure elements removed.

Spring 18 depresses the spreader 15 and with it the rocker 30 which, however, is maintained by suitable abutment means (described hereinafter with reference to FIG. 8) in a limiting position holding the roller 34 elevated above a plane tangent to the bottoms of all four wheels whereby the roller will not touch a road surface contacted by these wheels. It is only when the user lifts the front of the roller skate, causing it to swivel about rear axle 1, that roller 34 will engage the ground and with further swiveling will make the rocker 30 swing about its fulcrum (located below axle 1 as shown in FIG. 8) so as to raise the spreader 15 against the force of its loading spring 18, thereby moving the pressure elements 11 and 12 apart so that their outer faces will come into frictional contact with disks 9 and 10 of wheels 2 and 3. This is easily accomplished when the roller skate subjected to this braking operation is on the leading foot; the user can control the rate of deceleration by choosing the proper tilt angle. Even with rapid braking, the frictionally generated heat is readily dissipated by the metallic disks 9 and 10 without harm to the plastic material of the wheels.

As further shown in FIG. 5, each pressure element 11 and 12 is subdivided into two prismatic blocks 80, 82 and 81, 83, the inner blocks 80 and 81 being metallic while the outer blocks 82 and 83 are made of a plastic material which could be the same (e.g. polyurethane) as that used for the roller 34 and the wheels 2, 3 but could also be a cheaper, faster-wearing synthetic resin. The use of polymeric material for friction blocks 82 and 83 insures a softer contact and therefore a less abrupt braking action than would be the case with metallic blocks. The detachability of the outer blocks 82 and 83 from the inner blocks 80 and 81, to which they may be secured by screws 72 (only one shown), allows them to be readily replaced in the event of excessive wear.

Corresponding pressure elements in subsequent Figures, while not so illustrated, may be similarly subdivided into metallic inner and plastic outer portions detachable from each other.

Figure 6:
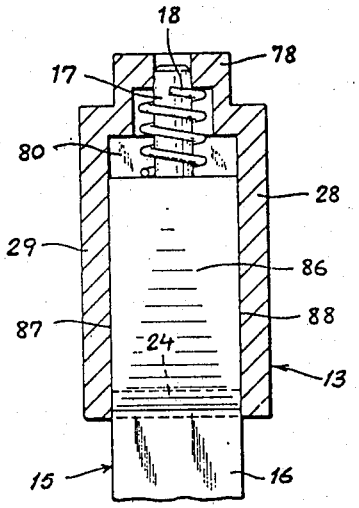
FIG. 6 is a cross-sectional view taken on the line VI—VI of FIG. 5.

FIG. 6 shows that parallel vertical sides 87 and 88 of spreader 15 are also positively guided between sidewalls 28, 29 of housing 13, thereby avoiding any possible canting of that spreader.

Figure 7:
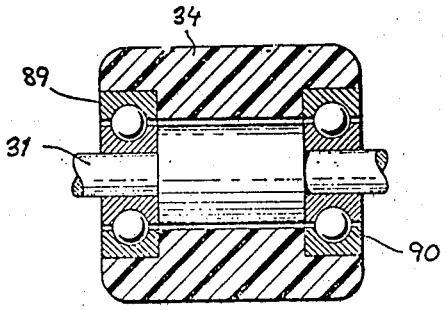
FIG. 7 is an axial sectional view of a control roller forming part of the brake attachment.

As illustrated in FIG. 7, roller 34 may be supported on its stud 31 by a pair of ball bearings 89, 90. As shown in FIG. 10, however, I may use a low-friction bushing 35 (of metal or Teflon, for example) in lieu of such bearings.

Figure 9:
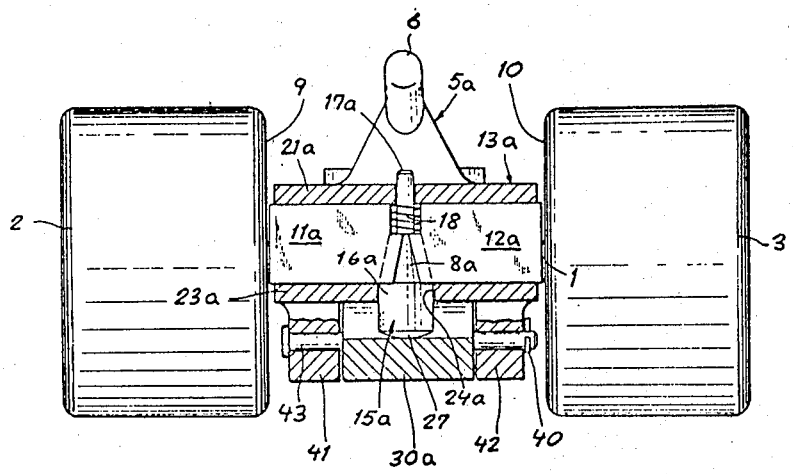
FIG. 9 is a rear view of an assembly similar to that of FIG. 2, including the modified brake attachment shown in section on line IX—IX of FIG. 8.

Reference will now be made to FIGS. 8–10 showing the modified rocker 30*a* with a bifurcate tail end having prongs 32*a* and 33*a*, each of these prongs being formed with several holes 36, 37 for the passage of mounting stud 31 whereby roller 34 may be positioned at different distances from wheels 2, 3 and at different elevations above ground for a faster or a slower braking action. Rocker 30*a* is flanked by lugs 41, 42 depending from a housing 13*a* which is integral with a truck 5*a* similar to truck 5 of the preceeding embodiment; these lugs are traversed by a headed stud 43, held in position by a cotter pin 40, on which the rocker 30*a* is fulcrumed directly below axle 1. A modified spreader 15*a* with a cylindrical base 16*a* guided in the lower wall 23*a* of housing 13*a* has a frustoconical intermediate portion 8*a* which converges upwardly and terminates in a tip 17*a* similar to the tip 17 of the aforedescribed spreader 15; a loading spring 18 again surrounds this tip and bears upon the upper housing wall 21*a* in which the latter is guided. Pressure elements 11*a* and 12*a* slidable in housing 13*a* have frustoconically concave faces contacting section 8*a* of spreader 15*a* whose operation is analogous to that described with reference to the wedge-shaped spreader 15 of FIGS. 5 and 6.

The front end of rocker 30*a* forms a ridge 39 with a part-cylindrical curvature merging into a flat land which rests against a shoulder 44 in the limiting position of FIG. 8 whereby the roller 34 is held elevated above ground. Thus, rocker 30*a* can swing only clockwise from that limiting position to raise the spreader 15*a* whose base 16*a* has a convex bottom end 27 adapted to roll on the upper surface of the rocker.

Figure 11:
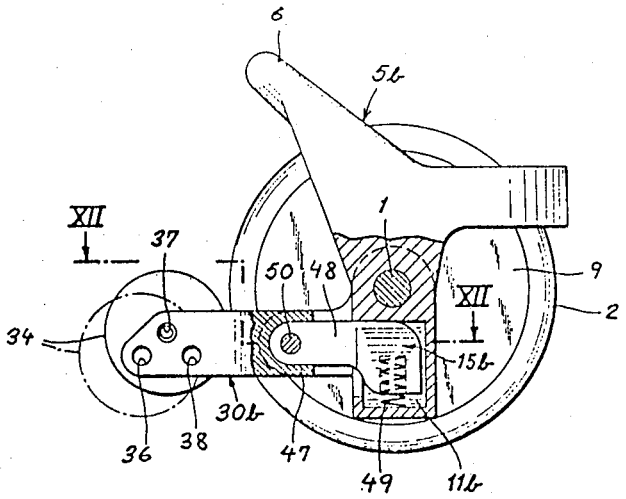
FIG. 11 is a part-sectional view similar to that of FIG. 8 but showing a further modification.
Figure 12:
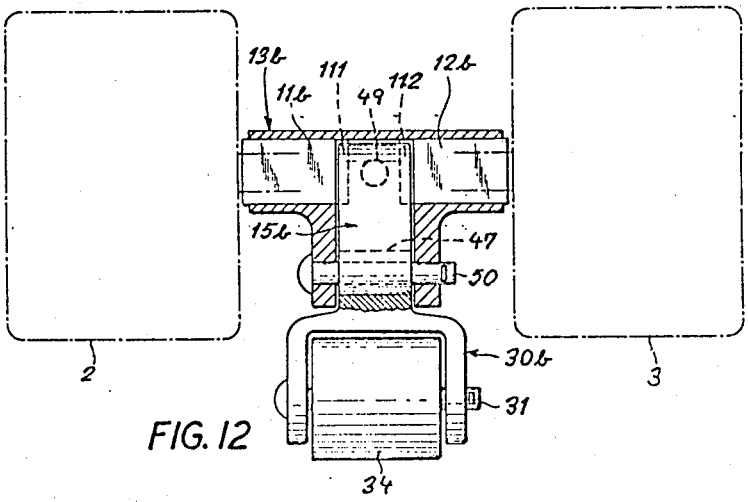
FIG. 12 is a top view taken partly in section on the line XII—XII of FIG. 11.

In FIGS. 11 and 12 I have shown a truck 5*b* rigid with a housing 13*b* which in this instance extends vertically below axle 1. Two pressure elements 11*b* and 12*b* slidable in this housing have downwardly converging beveled faces 111, 112 adjoining a spreader 15*b* with similarly converging sides; this spreader has a generally horizontal rearward extension or lever 48 swingable about a pivot pin 50 which traverses the housing 13*b* and also serves as a fulcrum for a rocker 30*b* whose bifurcate tail end is similar to that of rockers 30 and 30*a* shown in preceding Figures. Member 30*b* has a hollow front end 47 positively embracing the lever like extension 48 of spreader 15*b* whereby the rocker and the spreader are jointly swingable in a clockwise sense (as viewed in FIG. 11) about fulcrum 50 from the limiting position of that Figure defined by contact between extension 48 and the upper wall of housing 13*b*. The tail end of rocker 30*b* is here provided with three sets of holes 36, 37, 38 for a selective mounting of roller 34 in several positions.

A coil spring 49, inserted between the bottom wall of housing 13*b* and spreader 15*b*, tends to maintain the rocker in the limiting position referred to. When a counterclockwise tilting of the roller skate about axle 1 swings the rocker 30*b* clockwise with reference to truck 5*b*, pressure elements 11*b* and 12*b* are driven apart as in the preceding instances to exert a braking force upon the wheels 2 and 3.

It should be noted that only the spreader 15, 15*a*, 15*b* is shown spring-biased in the embodiments described up to now; the associated pressure elements will spontaneously move away from the rapidly rotating wheels toward a position close to each other. If necessary, however, these elements could be interconnected by a weak spring tending to keep them away from the confronting disks 9 and 10 of the inner wheel faces.

Figure 13:
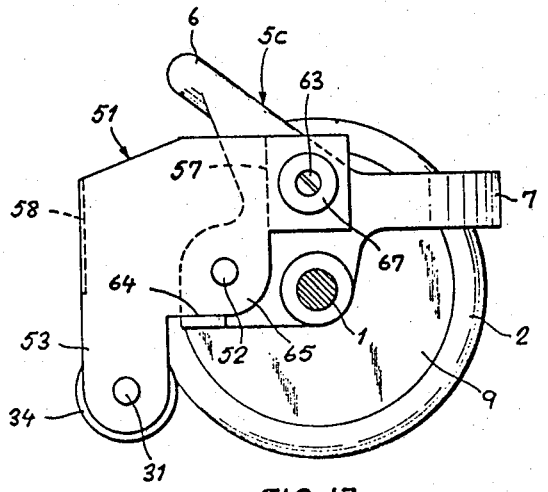
FIG. 13 is a further view similar to FIG. 8, relating to another embodiment.
Figure 14:
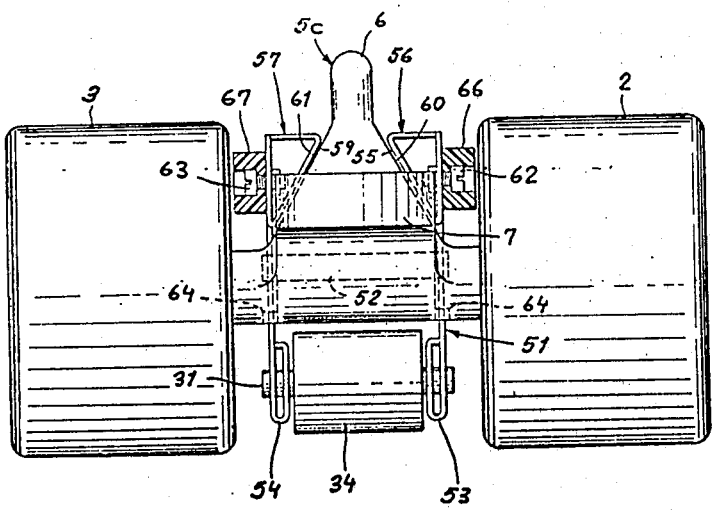
FIG. 14 is a front view of the assembly of FIG. 13.

The embodiment of FIGS. 13 and 14 comprises a truck 5*c* with upwardly converging camming surfaces 60 and 61 confronting similarly converging beveled surfaces 55 and 59 of a pair of pressure elements 56 and 57 which constitute forward extremities of two lateral arms of a resilient metallic bracket 51 flanking the truck 5*c*. Bracket 51 has a rear wall 58 interconnecting these lateral arms which also have reinforced depending portions 53 and 54 supporting the mounting stud 31 of control roller 34. Bracket 51 is pivoted on truck 5*c* by a pin 52 disposed to the rear of wheel axle 1; the limiting position shown in FIG. 13 is established by contact between a shoulder 64 of truck 5*c* and lateral cheeks 65 of the bracket whose configuration is similar to that of ridge 39 shown in FIG. 8.

Pressure elements 56 and 57 are traversed by screws 62, 63 of opposite pitch holding in position a pair of replaceable friction layers 66 and 67 on the outer brake surfaces of these pressure elements.

In operation, the brack attachment of FIGS. 13 and 14 forces the wedge-shaped pressure elements 56 and 57 into the gap between truck 5*c* and wheels 2, 3, which advantageously are again lined with metal disks 9 and 10, when roller 34 is lowered into contact with the ground by a counterclockwise tilting of the roller skate about axle 1 as viewed in FIG. 13.

The angle included between camming surfaces 60, 61 of FIG. 14 ought to be somewhat larger than the vertex angle of wedge pieces 15, 15*a*, 15*b* of the preceding embodiments (ranging from slightly less than 10° to a little over 20°) in order to bias the bracket 51 into its illustrated limiting position by the resiliency of its arms carrying the pressure elements 56 and 57. If necessary, the bracket may be additionally springbiased for this purpose, e.g. by a tensil spring interlinking its arms or by a hairpin spring anchored to the truck and the bracket.

The brake attachment of FIGS. 13 and 14 could be inverted by designing truck 5*c* with downwardly rather than upwardly converging camming surfaces, provided that the fulcrum 52 of bracket 51 is relocated to a position forwardly of axle 1. In that instance, however, the lateral bracket arms terminating in pressure elements 56, 57 would have to be located below the axle 1 where the available space is rather limited.

Bracket 51 may be conveniently bent from a single sheet-metal stamping, with the lower ends 53, 54 of its arms folded into several plies for properly supporting the roller stud 31.

As will be readily apparent, existing skating devices can be equipped with my brake attachment by merely substituting same for the conventional rear truck thereof, with or without the installation of contact disks 9, 10.

I claim:

1. In a wheeled skating device having at least one front wheel and a pair of rear wheels journaled on a transverse axle, the combination therewith of:

a truck member between said rear wheels supporting said axle;

a bracket fulcrumed on said truck member for limited swinging about a pivotal axis extending rearwardly of said axle in a direction perpendicular to said rear wheels, said bracket having a pair of flexible lateral arms with front extremities carrying wedge-shaped formations and extending between said rear wheels;

a roller journaled on a tail end of said bracket rearwardly of said axle;

resilient means tending to maintain said bracket in a limiting position relative to said truck member in which said roller is elevated above a road surface contacted by all said wheels; and an upwardly converging extension on said truck member straddled by and coacting with said wedge-shaped formations for driving said front extremities into frictional engagement with said rear wheels upon an elevation of said front wheel sufficient to lower said roller onto the road surface and to swing said bracket about said pivotal axis against the force of said resilient means whereby a braking force is exerted on said rear wheels.

2. The combination defined in claim 1 wherein said rear wheels consist of polymeric material and have inner faces overlain by metallic disks confronting said wedge-shaped formations.

3. The combination defined in claim 1 wherein said bracket consists of elastic material, said resilient means being a rear part of said bracket interconnecting said arms.

4. In a wheeled skating device having at least one front wheel and a pair of rear wheels journaled on a transverse axle, the combination therewith of:

a truck member between said rear wheels supporting said axle and forming a housing disposed below said axle;

a rocker member fulcrumed on said truck member for limited swinging about a pivotal axis perpendicular to said rear wheels;

a roller journaled on a tail end of said rocker member rearwardly of said axle;

resilient means tending to maintain said rocker member in a limiting position relative to said truck member in which said roller is elevated above a road surface contacted by all said wheels;

a pair of pressure elements slidably disposed in said housing close to said rear wheels for displacement substantially parallel to said axle; and a spring-loaded spreader carried by said rocker member and interposed between said pressure elements for driving same into frictional engagement with said rear wheels upon an elevation of said front wheel sufficient to lower said roller onto the road surface and to swing said rocker member about said pivotal axis against the force of said resilient means whereby a braking force is exerted on said rear wheels, said spreader being swingable jointly with said rocker member about said pivotal axis.

5. The combination defined in claim 4 wherein said rear wheels consist of polymeric material and have inner faces overlain by metallic disks confronting said pressure elements.

6. In a wheeled skating device having at least one front wheel and a pair of rear wheels journaled on a transverse axle, the combination therewith of:

a truck member between said rear wheels supporting said axle;

a rocker member fulcrumed on said truck member for limited swinging about a pivotal axis extending rearwardly of said axle in a direction perpendicular to said rear wheels;

a roller journaled on a tail end of said rocker member rearwardly of said axle, said truck member forming a housing extending rearwardly from said axle above said rocker member;

resilient means tending to maintain said rocker member in a limiting position relative to said truck member in which said roller is elevated above a road surface contacted by all said wheels;

a pair of pressure elements slidably disposed in said housing close to said rear wheels on one of said members for displacement substantially parallel to said axle; and a spring-loaded spreader interposed between said pressure elements for driving same into frictional engagement with said rear wheels upon an elevation of said front wheel sufficient to lower said roller onto the road surface and to swing said rocker member about said pivotal axis against the force of said resilient means whereby a braking force is exerted on said rear wheels, said spreader being vertically guided in said housing and resting on said rocker member.

7. The combination defined in claim 6 wherein said rear wheels consist of polymeric material and have inner faces overlain by metallic disks confronting said pressure elements.

8. The combination defined in claim 6 wherein said spreader has a base guided in a lower wall of said housing, a reduced tip guided in an upper wall of said housing, and a tapering section between said base and said tip.

9. The combination defined in claim 2, 5 or 7 wherein said disks form seats for antifriction bearings supporting said rear wheels.

10. The combination defined in claim 2, 5 or 7 wherein said roller consists of the same polymeric material as said rear wheels.

11. The combination defined in claim 1, 4 or 6 wherein said tail end is bifurcate with prongs straddling said roller, the latter being traversed by a pin spanning said prongs.

12. The combination defined in claim 11, further comprising low-friction bearing means inserted between said pin and said roller.

13. The combination defined in claim 8 wherein said tip is surrounded by a loading spring inserted between said tapering section and said upper wall.

14. The combination defined in claim 8 wherein said tapering section is frustoconical, said pressure elements having complementarily concave contact faces confronting said tapering section.

15. The combination defined in claim 8 wherein said tapering section has vertical sides guided between front and rear walls of said housing.

16. The combination defined in claim 4, 6 or 8 wherein each of said pressure elements is divided into a metallic inner portion proximal to said spreader and a detachable outer portion of polymeric material proximal to one of said rear wheels, said spreader being metallic.

* * * * *